US008533979B2

(12) United States Patent
Baker

(10) Patent No.: US 8,533,979 B2
(45) Date of Patent: Sep. 17, 2013

(54) SELF-ADJUSTING STUDS

(75) Inventor: Brian D. Baker, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 684 days.

(21) Appl. No.: 12/708,411

(22) Filed: Feb. 18, 2010

(65) Prior Publication Data

US 2011/0197478 A1 Aug. 18, 2011

(51) Int. Cl.
*A43C 15/02* (2006.01)
*A43C 15/16* (2006.01)

(52) U.S. Cl.
USPC ..... 36/59 R; 36/61; 36/126; 36/128

(58) Field of Classification Search
USPC ..... 36/59 R, 61, 126, 128, 59 C, 127
See application file for complete search history.

(56) References Cited

U.S. PATENT DOCUMENTS

| | | | | |
|---|---|---|---|---|
| D15,185 | S | 8/1884 | Brooks | |
| 303,287 | A * | 8/1884 | Hunn | 36/59 R |
| 830,324 | A | 9/1906 | Hunt | |
| 1,087,212 | A | 2/1914 | Caldwell | |
| 1,355,827 | A | 10/1920 | Finneran | |
| 1,361,078 | A | 12/1920 | Lynn | |
| 1,528,782 | A | 11/1924 | Perry | |
| 1,736,576 | A | 11/1929 | Cable | |
| D81,917 | S | 9/1930 | Burchfield | |
| 1,876,195 | A | 9/1932 | Youman | |
| 2,087,945 | A | 7/1937 | Butler | |
| 2,095,095 | A | 10/1937 | Howard | |
| 2,222,650 | A * | 11/1940 | Brady | 36/59 R |
| 2,258,734 | A * | 10/1941 | Brady | 36/59 R |
| D171,130 | S | 12/1953 | Gruner | |
| 3,043,026 | A | 7/1962 | Semon | |
| 3,063,171 | A | 11/1962 | Hollander | |
| D201,865 | S | 8/1965 | Bingham, Jr. et al. | |
| 3,328,901 | A | 7/1967 | Strickland | |
| 3,341,952 | A | 9/1967 | Dassler | |
| 3,352,034 | A | 11/1967 | Braun | |
| D213,416 | S | 3/1969 | Dittmar et al. | |

(Continued)

FOREIGN PATENT DOCUMENTS

| | | |
|---|---|---|
| CA | 2526727 | 5/2007 |
| DE | 930798 | 7/1955 |

(Continued)

OTHER PUBLICATIONS

International Search Report and Written Opinion mailed Jun. 13, 2012 in International Application No. PCT/US2012/021663.

(Continued)

*Primary Examiner* — Ted Kavanaugh
(74) *Attorney, Agent, or Firm* — Banner & Witcoff, Ltd.

(57) ABSTRACT

Articles of footwear may include self-adjusting studs that adjust to various types of conditions, environmental changes, and applied forces. The self-adjusting studs may have a first portion and a second portion of different levels of compressibilities and/or retractabilities that compress and extend based on the type of surface on which the wearer is walking or running. This footwear with self-adjusting studs may easily transition between surfaces of varying hardness without causing damage to the surface, but also providing the wearer with the necessary amount of traction on each type of surface. Wearers will enjoy the benefit of being able to move on various surfaces without the need to change their footwear multiple times to accommodate the wearer's varying traction needs on different surfaces.

24 Claims, 5 Drawing Sheets

(56) References Cited

U.S. PATENT DOCUMENTS

D219,503 S 12/1970 Vietas
3,597,863 A 8/1971 Austin et al.
3,619,916 A 11/1971 Neri
3,631,614 A 1/1972 Rice
3,656,245 A 4/1972 Wilson
3,775,874 A 12/1973 Bonneville
3,951,407 A 4/1976 Calacurcio
4,096,649 A 6/1978 Saurwein
4,107,858 A 8/1978 Bowerman et al.
4,146,979 A * 4/1979 Fabbrie ..... 36/67 D
D255,957 S 7/1980 Pasquier
4,245,406 A 1/1981 Landay et al.
4,271,608 A * 6/1981 Tomuro ..... 36/61
4,315,374 A 2/1982 Sneeringer
4,335,530 A 6/1982 Stubblefield
4,347,674 A 9/1982 George
4,375,728 A 3/1983 Dassler
4,375,729 A 3/1983 Buchanen, III
4,392,312 A 7/1983 Crowley et al.
D271,159 S 11/1983 Muller-Feigelstock
D272,200 S 1/1984 Autry et al.
D272,772 S 2/1984 Kohno
4,454,662 A 6/1984 Stubblefield
4,466,205 A * 8/1984 Corbari ..... 36/134
D278,759 S 5/1985 Norton et al.
4,574,498 A 3/1986 Norton et al.
4,586,274 A 5/1986 Blair
D287,662 S 1/1987 Tonkel
4,633,600 A 1/1987 Dassler et al.
4,674,200 A 6/1987 Sing
4,689,901 A 9/1987 Ihlenburg
4,698,923 A 10/1987 Arff
4,715,133 A * 12/1987 Hartjes et al. ..... 36/127
D294,655 S 3/1988 Heyes
D295,231 S 4/1988 Heyes
4,833,796 A 5/1989 Flemming
4,858,343 A 8/1989 Flemming
4,873,774 A 10/1989 Lafever
5,025,573 A 6/1991 Giese et al.
5,174,049 A 12/1992 Flemming
5,201,126 A 4/1993 Tanel
5,221,379 A 6/1993 Nicholas
D339,459 S 9/1993 Yoshikawa et al.
5,289,647 A 3/1994 Mercer
5,299,369 A 4/1994 Goldman
5,335,429 A 8/1994 Hansen
5,351,422 A 10/1994 Fitzgerald
5,367,791 A 11/1994 Gross et al.
5,384,973 A 1/1995 Lyden
5,406,723 A 4/1995 Okajima
5,410,823 A 5/1995 Iyoob
5,452,526 A 9/1995 Collins
5,461,801 A 10/1995 Anderton
5,473,827 A 12/1995 Barre et al.
D368,156 S 3/1996 Longbottom et al.
D368,360 S 4/1996 Wolfe
D369,672 S 5/1996 Tanaka et al.
5,513,451 A 5/1996 Kataoka et al.
5,524,364 A 6/1996 Cole et al.
5,526,589 A 6/1996 Jordan
5,555,650 A 9/1996 Longbottom et al.
5,572,807 A 11/1996 Kelly et al.
5,617,653 A 4/1997 Walker et al.
5,634,283 A * 6/1997 Kastner ..... 36/61
5,678,328 A 10/1997 Schmidt et al.
D387,892 S 12/1997 Briant
D389,298 S 1/1998 Briant
5,709,954 A 1/1998 Lyden et al.
D394,943 S 6/1998 Campbell et al.
5,761,832 A 6/1998 George
5,775,010 A 7/1998 Kaneko
5,806,209 A 9/1998 Crowley et al.
5,815,951 A 10/1998 Jordan
5,832,636 A 11/1998 Lyden et al.
5,946,828 A 9/1999 Jordan et al.
5,956,871 A 9/1999 Korsen
5,979,083 A 11/1999 Robinson et al.
5,983,529 A 11/1999 Serna
5,987,783 A 11/1999 Allen et al.
6,016,613 A 1/2000 Campbell et al.
D421,833 S 3/2000 Fallon
6,035,559 A 3/2000 Freed et al.
6,079,127 A 6/2000 Nishimura et al.
D427,754 S 7/2000 Portaud
6,101,746 A 8/2000 Evans
6,112,433 A 9/2000 Greiner
6,125,556 A 10/2000 Peckler et al.
6,145,221 A 11/2000 Hockerson
6,161,315 A 12/2000 Dalton
D437,108 S 2/2001 Peabody
D437,989 S 2/2001 Cass
6,199,303 B1 3/2001 Luthi et al.
6,231,946 B1 5/2001 Brown, Jr. et al.
6,256,907 B1 7/2001 Jordan et al.
6,357,146 B1 3/2002 Wordsworth et al.
6,389,714 B1 5/2002 Mack
D461,297 S 8/2002 Lancon
6,481,122 B2 11/2002 Brahler
6,550,160 B2 4/2003 Miller, II
D477,905 S 8/2003 Adams et al.
D478,714 S 8/2003 Recchi
6,647,647 B2 11/2003 Auger et al.
6,675,505 B2 1/2004 Terashima
6,698,110 B1 * 3/2004 Robbins ..... 36/61
6,708,427 B2 3/2004 Sussmann et al.
6,725,574 B2 4/2004 Hokkirigawa et al.
6,739,075 B2 5/2004 Sizemore
6,754,984 B2 6/2004 Schaudt et al.
D495,122 S 8/2004 McMullin
6,834,446 B2 12/2004 McMullin
6,892,479 B2 5/2005 Auger et al.
6,904,707 B2 6/2005 McMullin
6,915,595 B2 7/2005 Kastner
6,915,596 B2 7/2005 Grove et al.
6,935,055 B2 8/2005 Oorei
6,941,684 B2 9/2005 Auger et al.
6,954,998 B1 10/2005 Lussier
6,968,637 B1 11/2005 Johnson
6,973,745 B2 12/2005 Mills et al.
6,973,746 B2 12/2005 Auger et al.
7,007,410 B2 3/2006 Auger et al.
D525,416 S 7/2006 Auger et al.
7,143,530 B2 12/2006 Hudson et al.
7,181,868 B2 2/2007 Auger et al.
7,194,826 B2 3/2007 Ungari
7,204,044 B2 4/2007 Hoffer et al.
7,234,250 B2 6/2007 Fogarty et al.
7,254,909 B2 8/2007 Ungari
7,269,916 B2 9/2007 Biancucci et al.
7,287,343 B2 10/2007 Healy
7,370,439 B1 5/2008 Myers
D571,092 S 6/2008 Norton
D571,542 S 6/2008 Wilken
7,386,948 B2 6/2008 Sink
D573,779 S 7/2008 Stauffer
7,401,418 B2 7/2008 Wyszynski et al.
D575,041 S 8/2008 Wilken
7,406,781 B2 8/2008 Scholz
7,409,783 B2 8/2008 Chang
D578,280 S 10/2008 Wilken
7,430,819 B2 10/2008 Auger et al.
7,441,350 B2 10/2008 Auger et al.
7,490,418 B2 2/2009 Obeydani
7,536,810 B2 5/2009 Jau et al.
7,559,160 B2 7/2009 Kelly
7,584,554 B2 9/2009 Fogarty et al.
7,650,707 B2 1/2010 Campbell et al.
7,654,013 B2 2/2010 Savoie et al.
7,654,014 B1 2/2010 Moore et al.
7,665,229 B2 2/2010 Kilgore et al.
7,673,400 B2 3/2010 Brown et al.
7,685,741 B2 3/2010 Friedman
7,685,745 B2 3/2010 Kuhtz et al.
7,707,748 B2 5/2010 Campbell

| | | | |
|---|---|---|---|
| 7,762,009 | B2 | 7/2010 | Gerber |
| 7,784,196 | B1 | 8/2010 | Christensen et al. |
| 7,866,064 | B2 | 1/2011 | Gerber |
| 8,079,160 | B2 | 12/2011 | Baucom et al. |
| 8,122,617 | B1 | 2/2012 | Dixon et al. |
| 8,256,145 | B2 | 9/2012 | Baucom et al. |
| 2002/0017036 | A1 | 2/2002 | Berger et al. |
| 2002/0078603 | A1 | 6/2002 | Schmitt, Jr. |
| 2002/0100190 | A1 | 8/2002 | Pellerin |
| 2003/0033731 | A1 | 2/2003 | Sizemore |
| 2003/0188458 | A1 | 10/2003 | Kelly |
| 2004/0035024 | A1 | 2/2004 | Kao |
| 2004/0187356 | A1 | 9/2004 | Patton |
| 2004/0254045 | A1 | 12/2004 | McGee et al. |
| 2005/0016029 | A1 | 1/2005 | Auger et al. |
| 2005/0072026 | A1 | 4/2005 | Sink |
| 2005/0097783 | A1 | 5/2005 | Mills et al. |
| 2005/0120593 | A1 | 6/2005 | Mason |
| 2005/0217149 | A1 | 10/2005 | Ho |
| 2005/0257405 | A1 | 11/2005 | Kilgore |
| 2005/0268490 | A1 | 12/2005 | Foxen |
| 2006/0016101 | A1 | 1/2006 | Ungari |
| 2006/0021254 | A1 | 2/2006 | Jones |
| 2006/0021255 | A1 | 2/2006 | Auger et al. |
| 2006/0042124 | A1 | 3/2006 | Mills et al. |
| 2006/0130372 | A1 | 6/2006 | Auger et al. |
| 2006/0242863 | A1 | 11/2006 | Patmore |
| 2007/0039209 | A1 | 2/2007 | White et al. |
| 2007/0199211 | A1 | 8/2007 | Campbell |
| 2007/0199213 | A1 | 8/2007 | Campbell et al. |
| 2007/0261271 | A1 | 11/2007 | Krouse |
| 2007/0266597 | A1 | 11/2007 | Jones |
| 2008/0010863 | A1 | 1/2008 | Auger et al. |
| 2008/0066348 | A1 | 3/2008 | O'Brien et al. |
| 2008/0098624 | A1 | 5/2008 | Goldman |
| 2008/0196276 | A1 | 8/2008 | McMullin |
| 2008/0216352 | A1 | 9/2008 | Baucom et al. |
| 2009/0019732 | A1 | 1/2009 | Sussmann |
| 2009/0056169 | A1 | 3/2009 | Robinson, Jr. et al. |
| 2009/0056172 | A1 | 3/2009 | Cho |
| 2009/0100716 | A1 | 4/2009 | Gerber |
| 2009/0100718 | A1 | 4/2009 | Gerber |
| 2009/0113758 | A1 | 5/2009 | Nishiwaki et al. |
| 2009/0126230 | A1 | 5/2009 | McDonald et al. |
| 2009/0223088 | A1 | 9/2009 | Krikorian et al. |
| 2009/0241370 | A1 | 10/2009 | Kimura |
| 2009/0241377 | A1 | 10/2009 | Kita et al. |
| 2009/0249652 | A1 | 10/2009 | Gunthel et al. |
| 2009/0272008 | A1 | 11/2009 | Nomi et al. |
| 2009/0293315 | A1 | 12/2009 | Auger et al. |
| 2009/0307933 | A1 | 12/2009 | Leach |
| 2010/0050471 | A1 | 3/2010 | Kim |
| 2010/0077635 | A1 | 4/2010 | Baucom et al. |
| 2010/0083541 | A1 | 4/2010 | Baucom et al. |
| 2010/0126044 | A1 | 5/2010 | Davis |
| 2010/0199523 | A1 | 8/2010 | Mayden et al. |
| 2010/0212190 | A1 | 8/2010 | Schmid |
| 2010/0229427 | A1 | 9/2010 | Campbell et al. |
| 2010/0251578 | A1 | 10/2010 | Auger et al. |
| 2010/0313447 | A1 | 12/2010 | Becker et al. |
| 2011/0047830 | A1 | 3/2011 | Francello et al. |
| 2011/0078927 | A1 | 4/2011 | Baker |
| 2011/0088287 | A1 | 4/2011 | Auger et al. |
| 2011/0126426 | A1 | 6/2011 | mark |
| 2011/0203136 | A1 | 8/2011 | Auger |
| 2012/0180343 | A1 | 7/2012 | Auger et al. |

FOREIGN PATENT DOCUMENTS

| | | | |
|---|---|---|---|
| DE | 3046811 | | 7/1982 |
| DE | 3135347 | | 3/1983 |
| DE | 3245182 | | 5/1983 |
| DE | 3600525 | | 10/1987 |
| DE | 3644812 | | 6/1988 |
| DE | 3706069 | | 9/1988 |
| DE | 4417563 | | 11/1995 |
| DE | 19817579 | | 10/1999 |
| EP | 0115663 | | 8/1984 |
| EP | 0123550 | | 10/1984 |
| EP | 0223700 | | 5/1987 |
| EP | 723745 | | 7/1996 |
| EP | 1714571 | | 10/2006 |
| EP | 1839511 | | 10/2007 |
| EP | 2057913 | | 5/2009 |
| FR | 2567004 | | 1/1986 |
| FR | 2818876 | | 7/2002 |
| GB | 2113971 | | 8/1983 |
| GB | 2425706 | | 11/2006 |
| JP | 10000105 | A | 1/1998 |
| JP | 10066605 | | 3/1998 |
| JP | 2002306207 | | 10/2000 |
| JP | 2002272506 | | 9/2002 |
| JP | 2005185303 | | 7/2005 |
| JP | 2005304653 | | 11/2005 |
| JP | 2008212532 | | 9/2008 |
| TW | 540323 | U | 7/2003 |
| TW | M267886 | U | 6/2005 |
| WO | 0053047 | | 9/2000 |
| WO | 03045182 | | 6/2003 |
| WO | 03071893 | | 9/2003 |
| WO | 2006103619 | | 10/2006 |
| WO | 2008069751 | | 6/2008 |
| WO | 2008128712 | | 10/2008 |
| WO | 2009110822 | | 9/2009 |
| WO | 2010036988 | | 4/2010 |
| WO | 2010057207 | | 5/2010 |

OTHER PUBLICATIONS

Office Action mailed Jun. 13, 2012 in U.S. Appl. No. 12/582,252.

International Search Report and Written Opinion of PCT/US2010/029640 dated May 17, 2010.

International Search Report and Written Opinion of PCT/US2009/058522 dated Feb. 17, 2010.

U.S. Appl. No. 12/239,190, filed Sep. 26, 2008.

U.S. Appl. No. 12/566,792., filed Sep. 25, 2009.

U.S. Appl. No. 12/711,107, filed Feb. 23, 2010.

U.S. Appl. No. 12/572,154, filed Oct. 1, 2009.

International Search Report and Written Opinion for PCT/US2011/022841 dated Apr. 15, 2011.

International Search Report and Written Opinion for PCT/US2011/022848 dated Jun. 20, 2011.

Aug. 12, 2010, Icebug Web Page (date based on information from Internet Archive).

Dec. 23, 2008, Icebug Web Page (date based on information from Internet Archive).

U.S. Appl. No. 12/752,318, filed Apr. 1, 2010.

Partial Search Report for PCT/US2009/058522 dated Mar. 4, 2010.

International Search Report and Written Opinion for PCT/US2011/045356 dated Dec. 16, 2011.

International Search Report for PCT/US2010/050637 dated Jan. 14, 2011.

Pending U.S. Appl. No. 13/234,182, filed Sep. 16, 2011.

Pending U.S. Appl. o. 13/234,183, filed Sep. 16, 2011.

Pending U.S. Appl. No. 13/234,185, filed Sep. 16, 2011.

Pending U.S. Appl. No. 13/009,549, filed Jan. 19, 2011.

Pending U.S. Appl. No. 13/234,244, filed Sep. 16, 2011.

Pending U.S. Appl. No. 12/582,252, filed Oct. 20, 2009.

Pending U.S. Appl. No. 13/234,233, filed Sep. 16, 2011.

Pending U.S. Appl. No. 13/234,180, filed Sep. 16, 2011.

Response to Office Action filed Sep. 12, 2012 in U.S. Appl. No. 12/582,252.

Notice of Allowance mailed Sep. 20, 2012 in U.S. Appl. No. 12/582,252.

* cited by examiner

SELF-ADJUSTING STUDS

FIELD OF THE INVENTION

Aspects of the invention relate generally to traction elements for articles of manufacture and articles of wear. In some more specific examples, aspects of the invention relate to self-adjusting traction elements for articles of footwear.

BACKGROUND

Many articles of wear benefit from traction elements. Such articles of wear come into contact with a surface or another item and benefit from the increased friction and stability provided by traction elements. Traction elements typically form a portion of the ground-contact surface of the article of wear. Many traction elements form protrusions that extend away from the surface of the article of wear toward the ground or other surface that contacts the article of wear. Some traction elements are shaped or configured to pierce the ground or surface when the article of wear comes into contact with the ground or surface. Other fraction elements are shaped or have characteristics that engage with the ground in a way that increases the friction between the article of wear and the surface that it contacts. Such traction elements increase lateral stability between the traction element and the ground or surface and reduce the risk that the article of wear will slide or slip when it contacts the ground or surface.

Many people wear footwear, apparel, and athletic and protective gear and expect these articles of wear to provide traction and stability during use. For example, articles of footwear may include traction elements that are attached to a sole structure that forms the ground-contact surface of the article of footwear. The traction elements provide gripping characteristics that help create supportive and secure contact between the wearer's foot and the ground. These traction elements typically increase the surface area of the ground-contact surface of the footwear and often form protrusions that are usually shaped or configured to pierce the ground and/or create friction between the ground-contact surface of the footwear and the ground or surface that it contacts.

These traction elements usually are solid protrusions that are static with respect to the article of footwear. This means that the traction elements and the footwear move as a single unit, i.e., the traction elements remain stationary with respect to the footwear. The traction elements progress through the bending and flexing motions of the step or run cycle in the same way as the rest of the sole structure of the footwear. This configuration limits traction capabilities because it cannot adapt to the various forces being applied to the article of wear or the changing environments in which the article of footwear is being used.

Athletes engaged in certain sports such as soccer, baseball, and football often utilize footwear having traction elements. These athletes perform various movements that have sudden starts, stops, twisting, and turning. Additionally, most athletes wish to wear their articles of footwear in various environments with surfaces having different conditions and characteristics. On many occasions, the static traction elements are unable to provide adequate support and traction that the athlete needs to perform the various movements. The static traction elements simply cannot adapt to the changing movements of these athletes or the various environments in which the athletes wear the articles of footwear. Rather, the static traction elements provide the same type and amount of traction during all movements and in all environments, regardless of the type of movement being performed by the athlete or the characteristics of the environment in which the articles of footwear are being worn.

Additionally, various surfaces on which the athlete wishes to wear their articles of footwear have many different characteristics including different hardnesses and contours. For example, an athlete may utilize studded footwear on a playing field made of grass or a synthetic material similar in nature to grass. Many of these playing fields are outdoors and the conditions of the fields are subject to weather conditions, varying degrees of maintenance performed on the surfaces, regional (geographical) surface differences, and the like. For example, athletes that usually practice on a grass field that is rather soft may find that their cleated footwear functions differently on a grass field that is hard, such as when the athlete plays a game at another location or the weather causes the field conditions to harden the surface. By wearing the same cleats on all surfaces, wearers are at greater risk of falling, sliding, and/or otherwise injuring themselves, at least under such circumstances in which the static traction elements provided on the article of footwear are not well-designed for use under the field conditions. The alternative is to purchase several different pairs of cleated footwear with varying types of traction to accommodate several different surfaces. However, this method is expensive and inconvenient.

Therefore, while some traction elements are currently available, there is room for improvement in this art. For example, articles of wear having traction elements that may be self-adjusting to provide a user with traction that automatically adjusts based on the type of surface with which the article of wear is in contact and the types of forces applied to the traction elements would be a desirable advancement in the art.

SUMMARY

The following presents a general summary of aspects of the invention in order to provide a basic understanding of at least some of its aspects. This summary is not an extensive overview of the invention. It is not intended to identify key or critical elements of the invention and/or to delineate the scope of the invention. The following summary merely presents some concepts of the invention in a general form as a prelude to the more detailed description provided below.

Aspects of this invention relate to self-adjusting traction elements for articles of wear, such as footwear. In an example footwear embodiment, the article of footwear may incorporate a sole structure having one or more self-adjusting traction elements or "self-adjusting studs."

In one example, a self-adjusting stud may comprise a first portion having a first compressibility and a second portion having a second compressibility that is greater than the first compressibility. The second portion may surround the first portion. The first portion and the second portion may be substantially uncompressed when the self-adjusting stud comes into contact with a surface of a first hardness. The first portion may be substantially uncompressed and the second portion may be compressed when the self-adjusting stud comes into contact with a surface of a second hardness, wherein the first hardness is less than the second hardness.

In another example, a self-adjusting stud may comprise a stud body having a hole extending therethrough and a pin extending through the hole in the stud body. At least a portion of the stud body and a tip of the pin form a ground-contact surface of the self-adjusting stud. The stud body may be in a first, extended position when the self-adjusting stud contacts a surface having a first hardness and the stud body may be in a second, retracted position when the self-adjusting stud contacts a surface having a second hardness that is greater than the first hardness.

In yet another example, a sole structure may comprise a sole base member and at least one self-adjusting stud attached thereto. The self-adjusting stud may be any of the example embodiments described above. In some examples, the sole structure includes more than one self-adjusting stud, either of the same embodiment or of different embodiments of the self-adjusting stud.

BRIEF DESCRIPTION OF THE DRAWINGS

A more complete understanding of the present invention and certain advantages thereof may be acquired by referring to the following description along with the accompanying drawings, in which like reference numbers indicate like features, and wherein.

Figure 1:
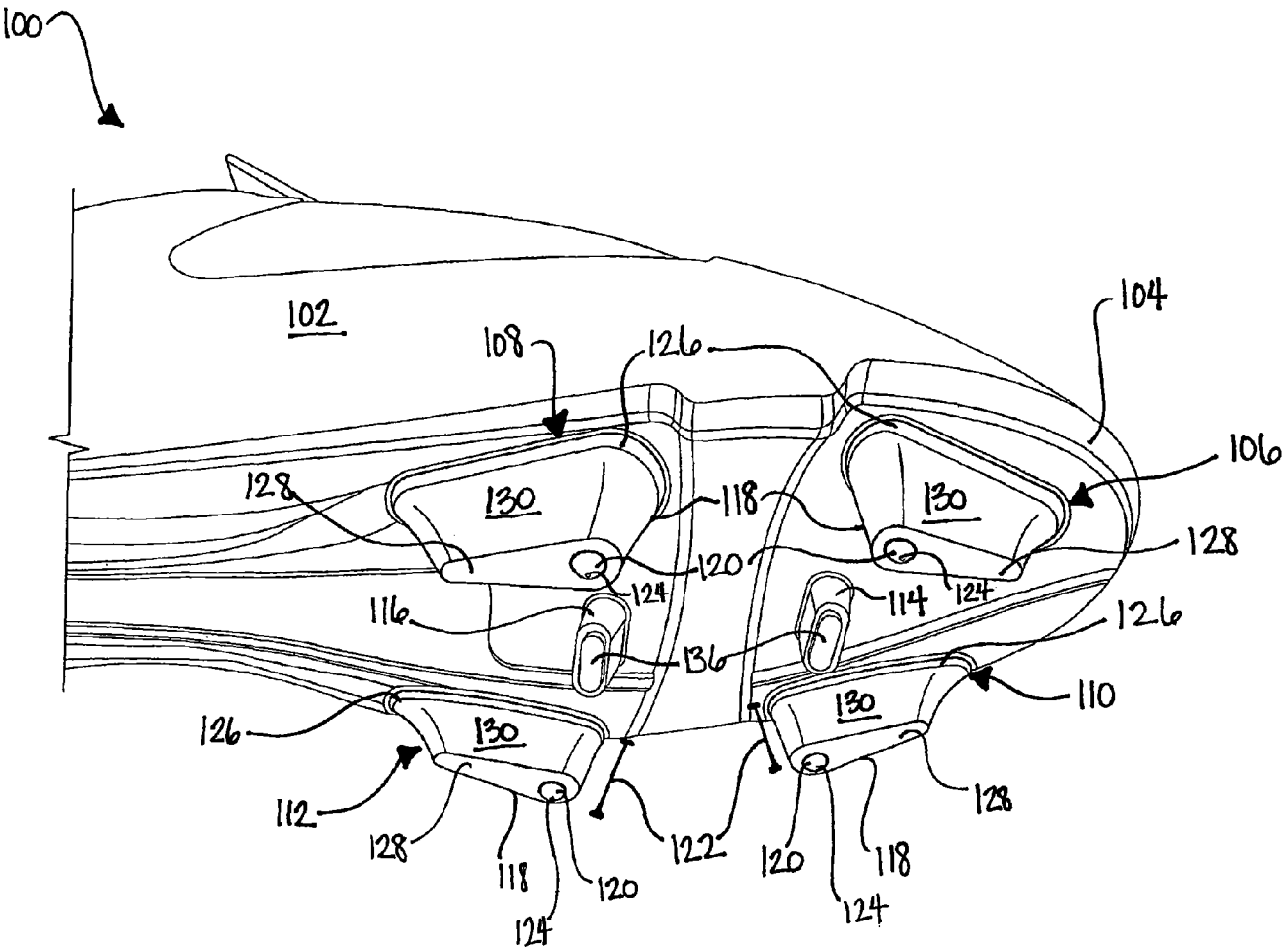
FIG. 1 illustrates a bottom perspective view of the forefoot region of an article of footwear having self-adjusting studs in accordance with aspects of the invention.

The reader is advised that the attached drawings are not necessarily drawn to scale.

DETAILED DESCRIPTION

In the following description of various example embodiments of the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

The articles of footwear disclosed herein include one or more self-adjusting studs that change their traction characteristics based on the type of surface with which the self-adjusting stud contacts, and/or the type of force that is applied to the self-adjusting stud thereby providing greater overall versatility and stability of the studded footwear and decreasing the chances that the wearers will get injured by unexpected or unfamiliar field conditions.

A. DEFINITIONS SECTION

To assist and clarify the subsequent description of various embodiments, various terms are defined herein. Unless otherwise indicated, the following definitions apply throughout this specification (including the claims).

The term "compressibility," as used herein, means the ability of the first portion and/or the second portion to condense, become more compact, or otherwise become reduced in size. The term "compressibility," as used herein, is used to describe the ability of a portion of a self-adjusting stud to become reduced in size in any way (height, width, thickness, volume, or any other reduction in size). A particular portion of the self-adjusting stud may be described as having a particular level of "compressibility," which means that it has been constructed with an ability to compress with respect to another portion of the self-adjusting stud.

For example, a first portion and a second portion of a self-adjusting stud may be assigned different "compressibilities" as they relate to each other. The first portion may compress more or less (depending on the embodiment) than the second portion with respect to a surface having a defined hardness (such as a hard surface like a gymnasium, artificial turf, or a frozen or near-frozen playing field). Atomically speaking, any force applied to a solid object will "compress" the atoms in the object to some degree (even objects made of the hardest materials available). However, the term "compressibility," as used herein, is meant to refer to a measurable difference in the amount of compression that occurs in a particular portion of the self-adjusting stud.

The terms "substantially uncompressed" and "compressed," as used herein, are meant to describe levels of compression of various portions of the self-adjusting studs. As discussed above, atomically speaking, any force applied to an object made of even the hardest of materials will "compress" the object to some degree. The term "substantially uncompressed," is intended to include those levels of compression in which none or only a very small amount of compression occurs (e.g., when the atoms move only slightly closer together). For example, a hard metal, such as titanium, may be used to form a portion of the self-adjusting stud. This titanium metal portion would typically be able to withstand most forces in a "substantially uncompressed" form because it does not substantially compress or become reduced in size when such forces are applied to it.

Use of the term "substantially uncompressed" is meant to include the levels of compressibility in which mere atoms move, but no noticeable change in traction capabilities occurs, such as in the titanium example previously described. The term "compressed," as used herein, is used to describe a noticeable or detectable difference in the volume or size of any portion of the self-adjusting stud from the perspective of an athlete or user or a size or volume difference that is measurable by generally available measurement tools, such as a ruler or detectable by the human eye. The difference will often, although not always, result in a size or volume change such that the traction characteristics of the self-adjusting stud will exhibit a noticeable change from the perspective of the athlete/wearer. In some example structures, the self-adjusting stud may compress up to 5-50% of its uncompressed size/shape. For example, if the compression occurs in the vertical direction, the height of the self-adjusting stud may be 25% less when it is compressed than when it is substantially uncompressed.

The term "hardness," as used herein is used to describe the type of surface that comes into contact with the self-adjusting stud. For example, a soft surface would have a lower hardness level than a hard surface. The soft surface may include a grass playing field or a field with flexible ground. The hard surface may include an artificial playing field or a playing field with firm ground. As described in greater detail below, the self-adjusting studs may be activated (compressed/retracted) on either hard or soft surfaces, depending on the embodiment.

B. GENERAL DESCRIPTION OF ARTICLES OF FOOTWEAR WITH SELF-ADJUSTING STUDS

The following description and accompanying figures disclose various articles of footwear that have self-adjusting studs. The self-adjusting studs may be incorporated into any article of manufacture or article of wear that would benefit from self-adjusting studs, such as, but not limited to, footwear, sporting equipment, protective gear, mats, and the like.

Sole structures of articles of footwear may have self-adjusting studs. The self-adjusting studs may be discrete elements from the sole structure or may be integrally formed with or incorporated into the sole structure. In some examples, the self-adjusting studs may be detachable (and/or replaceable) from the sole structure altogether. In other examples, the self-adjusting studs may be permanently attached to the sole structure and may be either a separate construction or may be formed from the same piece of material as the sole structure.

The sole structures may be incorporated into any type of article of footwear. In more specific examples, the sole structures are incorporated into athletic footwear for sports including, but not limited to soccer, football, baseball, track, golf, mountain climbing, hiking, and any other sport or activity in which an athlete would benefit from a sole structure having self-adjusting studs.

Generally, articles of footwear comprise an upper attached to a sole structure. The sole structure extends along the length of the article of footwear and may comprise an outsole that forms the ground contacting surface of the article of footwear. Traction elements may be attached to and form portions of the sole structure and/or ground contacting surface (e.g., the outsole). In some examples, the sole structure includes a sole base member and one or more self-adjusting studs.

Articles of footwear may generally be divided into three regions for explanatory purposes. The demarcation of each region is not intended to define a precise divide between the various regions of the footwear. The regions of the footwear may be a forefoot region, a midfoot region, and a heel region. The forefoot region generally relates to the portion of the foot of a wearer comprising the metatarsophalangeal joints and the phalanges. The midfoot region generally relates to the portion of the foot of a wearer comprising the metatarsals and the "arch" of the foot. The heel region generally relates to the portion of the wearer's foot comprising the heel or calcaneous bone.

One or more self-adjusting studs may be positioned in any region or a combination of regions of the sole structure of the article of footwear. For example, one or more self-adjusting studs may be positioned in the forefoot region of the article of footwear. Further, self-adjusting studs may be positioned on any side of the article of footwear including the medial side and the lateral side. In more specific examples, a self-adjusting stud may be positioned along the medial or lateral edge of the sole structure of the footwear. The self-adjusting studs also may be placed in the heel region of the article of footwear. The self-adjusting studs may be strategically positioned to provide additional traction when the wearers most need it, i.e., during specific targeted activities and/or when a particular kind of force is applied to the sole structure by the ground and/or the wearer's foot. The self-adjusting studs may be positioned in any suitable configuration on the sole structure and in any region of the sole structure.

Athletes may greatly benefit from the additional traction capabilities of the self-adjusting studs in their footwear during certain movements. Athletes participating in athletic activities, for example, may need to perform sudden or abrupt starting, stopping, turning, and/or twisting motions. Athletes also make quick changes in direction of their movement. Additionally, athletes may wish to compete on various surfaces (e.g., varying field conditions or terrains). Athletes may benefit from self-adjusting studs during these movements and in these different environments of use.

Generally, traction elements (and specifically self-adjusting studs) cause friction between the sole structure and the ground or surface that they contact to provide support and stability to the users of the articles of footwear during various movements. Traction elements increase the surface area of the sole structure and are often shaped and/or configured to pierce the ground when contact with the ground occurs. Such contact decreases lateral and rearward slip and slide of the footwear with the ground and increases stability for the wearer. Self-adjusting studs can provide fraction that is tailored to specific movements and that can change its characteristics based on the type of terrain or surface with which the sole structure comes into contact and based on the type(s) of forces being applied to the sole structure.

The self-adjusting studs may be any suitable shape and size. The surfaces of the self-adjusting studs may be smooth or textured and curved or relatively flat. The self-adjusting studs may have a smooth surface or may have edges or "sides," such as a polygon. The self-adjusting studs may be conical, rectangular, pyramid-shaped, polygonal, or other suitable shapes. In one example, an article of footwear may have a plurality of self-adjusting studs that are all uniform in shape. In another example, the plurality of self-adjusting studs on a single article of footwear may have various shapes. The self-adjusting studs may be any size. In the example configuration where a plurality of self-adjusting studs are attached to the sole structure, each of the self-adjusting studs may be the same size and/or shape or they may be of varying sizes and/or shapes. The ground-contact surface of the self-adjusting studs may be a point, a flat surface, or any other suitable configuration.

The sole structure may contain one or more self-adjusting studs. In some examples, the sole structure has a single self-adjusting stud. In another example, the sole structure has a plurality of self-adjusting studs. The self-adjusting stud(s) may be positioned within the forefoot region of the sole structure or any other region of the sole structure. For example, the sole structure may include a plurality of self-adjusting studs. A first portion of the plurality of self-adjusting studs may be positioned along the medial edge of the forefoot region of the sole structure and a second portion of the plurality of self-adjusting studs may be positioned along the lateral edge of the forefoot region of the sole structure. In essence, the plurality of studs may be positioned to frame the forefoot region along the border of the sole structure. This positioning helps to provide additional traction for the wearers during side-lateral movements.

In another example, the self-adjusting studs may be positioned in the heel region of the sole structure of the studded footwear. In even other examples, self-adjusting studs may be positioned in both the forefoot region and the heel region. By varying the configuration of the self-adjusting studs, the type of traction capabilities of the footwear can be varied and/or even customized to provide additional fraction to the wearer when the wearer performs a particular movement or engages in activities on surfaces having various characteristics.

Articles of footwear may include various types of self-adjusting studs. Some self-adjusting studs may be activated when the surface conditions change (i.e., such as the hardness and contour). For example, some of the self-adjusting studs may be activated when the surface conditions change from a relatively soft to a relatively hard condition. The self-adjusting studs may be activated by any change in the condition(s) of the surface that the article of footwear contacts.

In one example, a self-adjusting stud comprises: a first portion having a first compressibility and a second portion having a second compressibility that is greater than the first compressibility. The second portion surrounds the first portion. The first portion and the second portion are substantially uncompressed when the self-adjusting stud comes into contact with a surface of a first hardness. The first portion is substantially uncompressed and the second portion is compressed when the self-adjusting stud comes into contact with a surface of a second hardness. The first hardness is less than the second hardness.

The first portion may include any type of material(s), including, but not limited to hard thermoplastic polyurethane (TPU), metal, rubber, etc. A hard TPU may have a hardness rating of 90 or above on the Shore A hardness scale or a rating of greater than 40 on the Shore D hardness scale. The metal may be an alloy of metals (e.g., steel, aluminum, titanium, alloys containing one or more of these metals, etc.). The first portion may also include various plastics having a high hardness rating and other suitable materials. The first portion is a hard material, especially relative to the second portion. The first portion remains substantially uncompressed when it contacts both the surface with a first hardness (a relatively soft surface) and the surface with a second hardness (a relatively hard surface). The first portion includes a material that will not substantially compress when it contacts most surfaces, under normal conditions (e.g., normal running, jumping, and other athletic activities performed by an athlete wearing the footwear on a usual surface, such as a hard or soft field, artificial field, or other surface).

The first portion may be a pin. The pin may include any suitable material(s) such as, but not limited to, hard TPU, metal, metal alloy(s), rubber, hard plastics, and the like, as described above with respect to the first portion. The pin may have a length that is greater than its width. In some example embodiments, the pin may have a length that is at least as great as the height of the second portion so that the tip of the pin is either flush or extends beyond the ground-contact surface of the second portion. The pin may have a rounded, flat, or beveled tip or any other suitable tip. The tip of the pin and the ground-contact surface of the second portion may form a ground-contact surface of the self-adjusting stud. The tip of the pin may be flush with the surface of the second portion or it may be recessed within the second portion when the second portion is substantially uncompressed. In any of the configurations, the tip of the pin extends beyond the surface of the second portion when the second portion is compressed at least a predetermined amount. The width of the pin may account for less than 25% of the ground-contact surface of the self-adjusting stud (i.e., it may be much smaller than the surface of the second portion).

The second portion of this example self-adjusting stud is compressible. The second portion may include any variety of materials that are capable of being compressed, such as, compressible foam, rubber, soft thermoplastic polyurethane (TPU), and the like. The second portion may also have a two-plate structure that is capable of reducing the size of the second portion or otherwise "compressing." This two-plate structure includes at least a first and a second plate that are spaced apart from each other such that when a force is applied to the first plate, the space between the two plates is decreased (or reduced to nothing). A compressible foam or a spring (coil spring, leaf spring, etc.) may be positioned within the space between the first plate and the second plate such that the compressible foam or spring compresses when the force is applied to the first plate and helps to bias the plates back apart from one another after the force is removed from the first plate. The second portion may compress up to 3*mm* in this example construction.

The second portion completely surrounds the first portion in this example of the self-adjusting stud, although this is not a requirement in all such structures. As a more specific example, the second portion may be positioned proximate to the first portion or may be positioned some distance away from the first portion. The second portion may be positioned proximate to and, in this example, in a position that physically touches the first portion. The second portion may be positioned in any suitable manner with respect to the first portion such that the second portion may be compressed along the length of the first portion. In the example described above in which the first portion is a pin, the second portion may be positioned proximate to and in direct physical contact with the first portion in a manner that permits the second portion to slide along the surface of the longitudinal length of the pin as the second portion compresses when a force is applied to the self-adjusting stud (e.g., when the self-adjusting stud comes into contact with a hard surface).

In this embodiment of the self-adjusting stud, the first portion and the second portion are substantially uncompressed when the self-adjusting stud comes into contact with a surface of a first hardness. The first portion is substantially uncompressed and the second portion is compressed when the self-adjusting stud comes into contact with a surface of a second hardness. In this example, the first hardness is less than the second hardness (i.e., the surface of a first hardness is "softer" or more "flexible" than the surface of the second hardness). In this way, the second portion "peels back," compresses, or otherwise retracts in a direction away from the ground while the first portion remains substantially uncompressed and pierces the ground. A greater amount of the first portion is exposed when the second portion is compressed. In this example in which the first portion is a pin, a greater amount of the pin's length is exposed when the second portion is compressed. This permits a greater length of the pin to pierce the ground or other surface to provide additional traction. In some example structures, the second portion compresses up to 3 mm or more along the length of the pin (away from the ground).

In some examples, the pin (or first portion) is positioned such that its tip extends beyond the surface of the second portion when the second portion is substantially uncompressed. In this configuration, the tip of the pin extends slightly beyond the surface of the second portion and thus provides some degree of traction when the second portion is substantially uncompressed. When the second portion is compressed, the level of fraction and/or the type of traction that the pin can provide is increased because a greater amount of the length of the pin may pierce the ground. In other examples, the pin is flush or even recessed within the second portion, in which case the pin provides little or no traction when the second portion is substantially uncompressed. In this other example, the pin is only exposed when the second portion is compressed or otherwise retracted. The pin is able to pierce the ground when the second portion is compressed/retracted, which provides the self-adjusting stud with additional traction.

The second portion may be integrally formed with or attached to the sole structure or any other portion of the article of footwear. The pin may also be integrally formed with or attached to the sole structure or any other portion of the article of footwear. For example, the pin may be attached to the base plate of the sole structure of the article of footwear and the second portion may be attached to or integrally formed with the outsole of the sole structure. In this example, the pin can be cemented, glued, bonded, and/or attached via a mechanical connector to the base plate of the sole structure.

These example configurations of the self-adjusting studs are useful when the self-adjusting stud contacts relatively hard ground (e.g., ground hard enough to cause the second portion to compress). These configurations will "activate" the self-adjusting stud when the hard ground contacts the second portion and causes it to compress and expose a portion of (or a greater portion of) the first portion (or pin). The pin is then able to pierce the hard ground and provide additional traction in the hard ground. The additional traction is not activated when this example self-adjusting stud contacts soft ground that does not cause the second portion to substantially compress and expose the first portion or a greater portion of the first portion.

In these example configurations, the second portion may compress any suitable amount. For example, the size of the compressed second portion may be at least 5% smaller than the size of the uncompressed second portion. In another example, the size of the compressed second portion may be at least 25% smaller than the size of the uncompressed second portion or even at least 50% smaller.

Specific examples of the invention are described in more detail below. The reader should understand that these specific examples are set forth merely to illustrate examples of the invention, and they should not be construed as limiting the invention.

C. SPECIFIC EXAMPLES OF ARTICLES OF FOOTWEAR WITH SELF-ADJUSTING STUDS

The various figures in this application illustrate examples of articles of footwear with self-adjusting studs according to this invention. When the same reference number appears in more than one drawing, that reference number is used consistently in this specification and the drawings to refer to the same or similar parts throughout.

FIGS. 1-7 illustrate specific examples of embodiment 1 that is described above in the section entitled, "General Description of Articles of Footwear with Self-Adjusting Studs." FIG. 1 illustrates a bottom perspective view of a portion of a forefoot region of an article of footwear 100. The article of footwear 100 has an upper 102 and a sole structure 104 attached to the upper 102. Four self-adjusting studs 106, 108, 110, and 112 are attached to or integrally formed with the sole structure 104. Two static fraction elements 114, 116 are also attached to or integrally formed with the sole structure 104. Each of the self-adjusting studs 106, 108, 110, and 112 includes a study body 118 and a pin 120. The stud body 118 defines a hole extending through the stud body 118. In this example, the hole extends through the entire height 122 of the stud body 118. In other examples, the hole may extend through only a portion of the height 122 of stud body 118.

Figure 2:
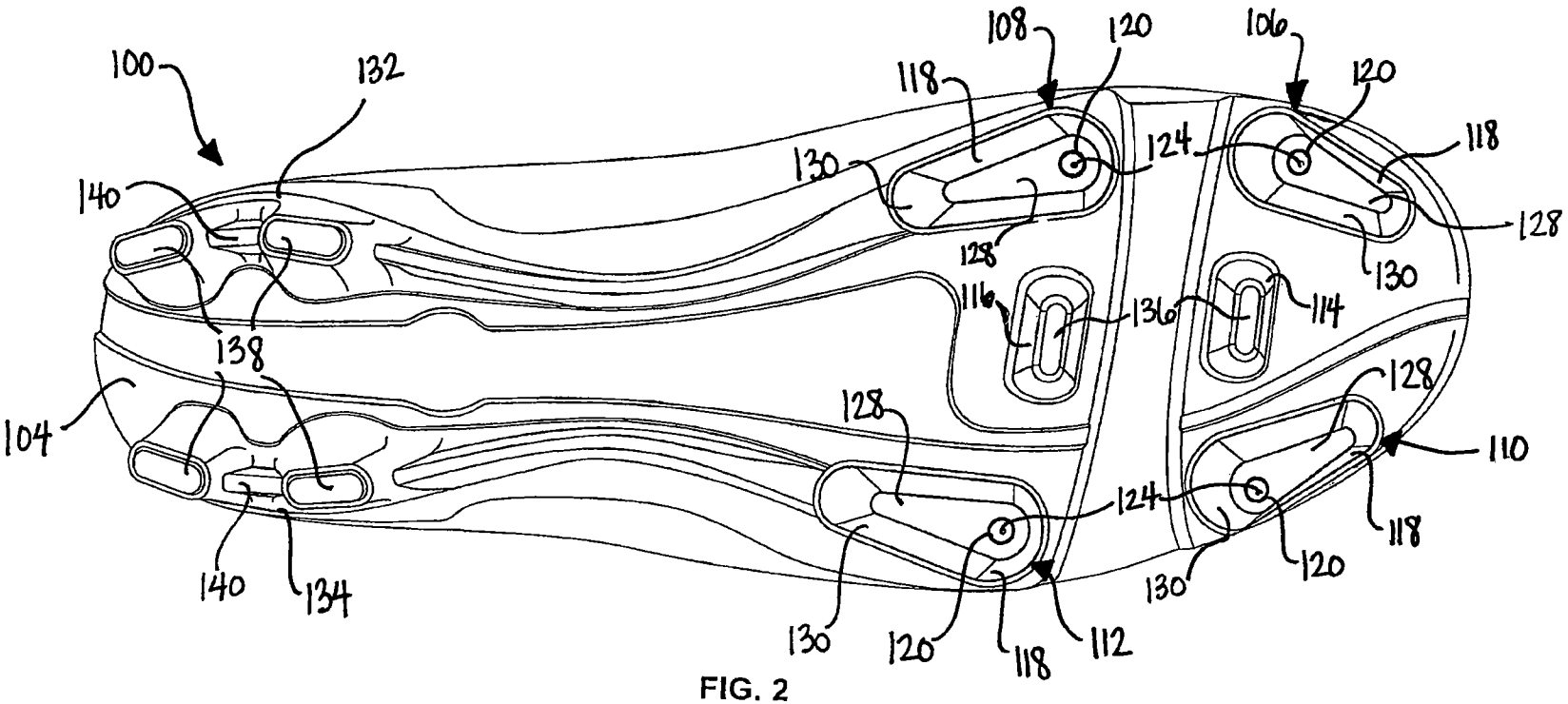
FIG. 2 illustrates a bottom plan view of the sole structure of an article of footwear having self-adjusting studs in accordance with aspects of the invention.

In the example constructions illustrated in FIGS. 1 and 2, the hole in the stud body 118 is sized to have a radius that is slightly greater than the radius of the pin 120 so that the stud body 118 is capable of sliding or otherwise moving along the length of the pin 120 when the stud body 118 is retracted from the first, extended position to the second, refracted position. The pin 120 has a length that extends through at least a portion of the hole in the stud body 118. In this example, the pin 120 has a height that exceeds the height 122 of the stud body 118 when the stud body 118 is in both the first, extended position and the second, retracted position. In some examples, the pin 120 has a height that exceeds the height 122 of the stud body 118 only when the stud body 118 is in the second, retracted position (e.g., when the pin's height is less than or equal to the height of the stud body when the stud body is in the first, extended position). In other example configurations, the pin 120 may have a height that is less than or equal to the height 122 of the stud body 118.

In the examples illustrated in FIGS. 1 and 2, a tip 124 of the pin 120 extends beyond the surface of the second end 128 of the stud body 118. In other examples, the tip 124 of the pin 120 is flush with the surface of the second end 128 of the stud body 118 or it may be recessed within the stud body 118. Regardless of the positioning of the pin 120 within the stud body 118, the length of the pin 120 of this example structure exceeds its radius (or width, depending on the shape) of the pin 120. In essence, the pin 120 is longer than it is wide. In some examples, such as the embodiment illustrated in FIGS. 1 and 2, the pin 120 is generally long and slender.

The stud body 118 has a first end 126 proximate to the sole structure 104, a second end 128 opposite the first end 126, and a side wall 130 interconnecting the first end 126 and the second end 128. The first end 126 may be permanently attached to or integrally formed with the sole structure 104 or may be selectively removable from the sole structure 104. In this example structure, the side wall 130 is smooth and curved so that the overall shape of the self-adjusting studs 106, 108, 110, and 112 is generally a three-dimensional teardrop shape. Also, the side walls 130 are shaped to taper the self-adjusting studs 106, 108, 110, and 112 as they extend away from the sole structure 104. The self-adjusting studs 106, 108, 110, and 112 may have one or more side walls 130 that are shaped in any suitable manner. The overall shape of the self-adjusting studs 106, 108, 110, and 112 may be any suitable shape. The second end 128 and a tip 124 of the pin 120 form the ground-contact surface of the self-adjusting studs 106, 108, 110, and 112. The second end 128 of the stud body 118 is a flat surface, although it may have any other suitable configuration (e.g., beveled, pointed, angled, etc.). The tip 124 of the pin 120 is rounded in this example, and also may have any other suitable configuration (e.g., beveled, pointed, angled, etc.).

The stud body 118 may include any suitable material(s), including but not limited to, soft TPUs (TPUs having a hardness rating on the Shore A scale below 90), rubber, compressible foam, and the like. The pin 120 may include any suitable material(s), including but not limited to hard TPUs (TPUs having a hardness rating on the Shore A scale above 90 or a hardness rating on the Shore D scale above 40), metal or a metal alloy, or the like.

FIG. 2 illustrates a bottom plan view of the sole structure 104 of the article of footwear 100. The sole structure 104 has four self-adjusting studs 106, 108, 110, and 112 and four static traction elements 114, 116, 132, and 134. The four self-adjusting studs 106, 108, 110, and 112 are positioned in the forefoot region of the sole structure 104. The first and second self-adjusting studs 106 and 108 are positioned along the medial edge of the sole structure 104 in the forefoot region. The third and fourth self-adjusting studs 110 and 112 are positioned along the lateral edge of the sole structure 104 in the forefoot region. The first self-adjusting stud 106 is positioned on the sole structure 104 to extend beneath at least a portion of the first phalange ("big toe") when the wearer's foot is positioned within the article of footwear 100. The second self-adjusting stud 108 is positioned on the sole structure 104 to extend approximately beneath the first metatarsophalangeal joint when the wearer's foot is positioned within the article of footwear 100. The third self-adjusting stud 110 is positioned on the sole structure 104 to extend beneath at least a portion of the fifth phalange when the wearer's foot is positioned within the article of footwear 100. The fourth self-adjusting stud 112 is positioned on the sole structure 104 to extend beneath at least a portion of the fifth metatarsophalangeal joint of the wearer's foot when the wearer's foot is positioned within the article of footwear 100.

The pin 120 may be positioned within any portion of the stud body 118. For example, the pin 120 may be positioned within the center of the stud body 118 or along one or more edges of the stud body 118. In the example illustrated in FIGS. 1 and 2, the pin 120 is located near an edge of the stud body 118.

The sole structure 104 illustrated in FIG. 2 also includes four static traction elements 114, 116, 132, and 134. The static traction elements 114, 116, 132, and 134 remain stationary when any type of force is applied to the sole structure 104 and/or the static traction elements 114, 116, 132, and 134. The static traction elements 114, 116, 132, and 134 in this example structure do not adjust or otherwise change their shape, size, or function when forces are applied to static traction elements 114, 116, 132, and 134 and/or the sole structure 104. The first static traction element 114 and the second static traction element 116 are positioned in the forefoot region of the article of footwear 100, approximately centered between the medial edge and the lateral edge.

The first static traction element 114 is positioned on the sole structure 104 approximately beneath at least a portion of the second, third, and/or fourth metatarsals of the wearer's foot when the wearer's foot is positioned within the article of footwear 100. The second static traction element 116 is positioned on the sole structure 104 approximately beneath at least a portion of the second, third, and/or fourth metatarsophalangeal joints of the wearer's foot when the wearer's foot is positioned within the article of footwear 100. The first and the second static traction elements 114, 116 are shaped similarly in this example, but each may be any suitable or desired shape. The first and the second static traction elements 114, 116 are tapered as they extend away from the surface of the sole structure 104 to define an edge 136 at their ground-contact surfaces. The edge 136 of the first and the second static traction elements 114, 116 is rounded in the example illustrated in FIGS. 1 and 2. However, the ground-contact surface of the static traction elements 114, 116 may be any suitable shape or configuration (e.g., sharp point, beveled edge, flat, etc.).

The third and fourth static traction elements 132, 134 illustrated in FIG. 2 are positioned on the sole structure 104 in the heel region of the article of footwear 100. The third static traction element 132 is positioned along the medial edge of the sole structure 104 in the heel region and the fourth static traction element 134 is positioned along the lateral edge of the sole structure 104 in the heel region. In this example, the third and the fourth static traction elements 132, 134 have two traction regions 138 and a bridge 140 interconnecting the two traction regions 138. The third and the fourth static traction elements 132, 134 may be shaped in any suitable or desired manner.

Figure 3A:
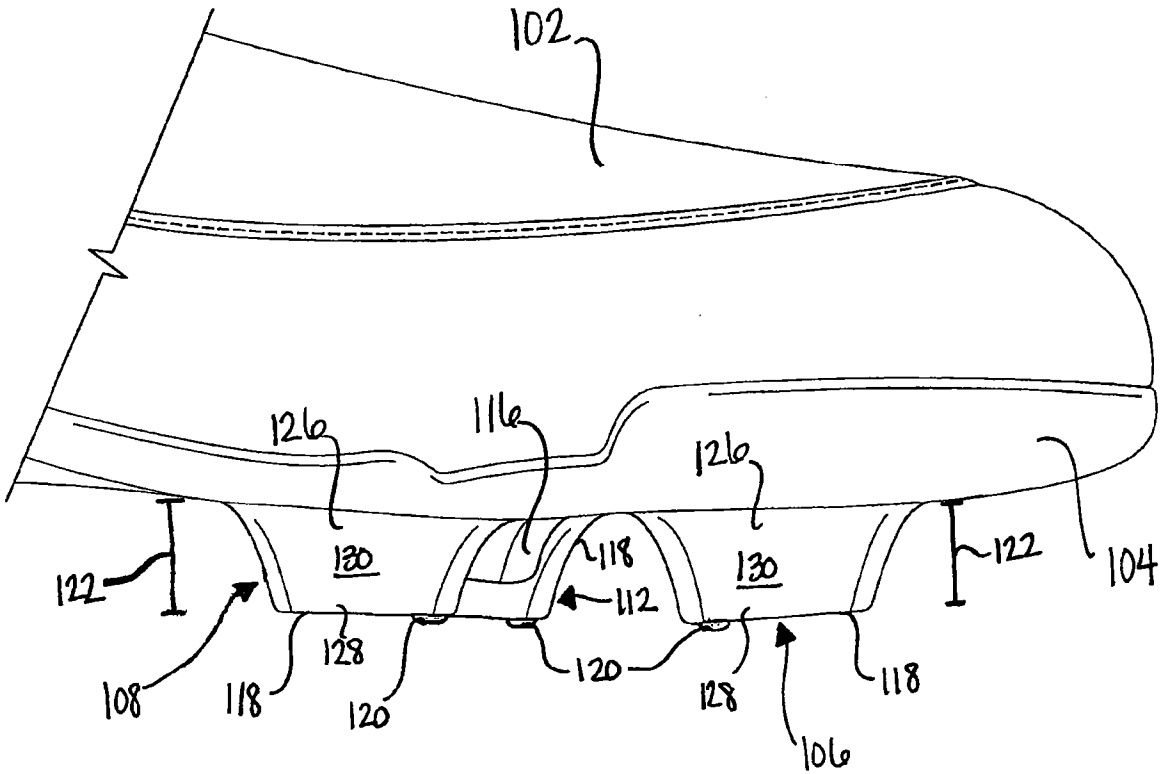
FIGS. 3A and 3B illustrate side views of the forefoot region of an article of footwear having self-adjusting studs in an uncompressed/unretracted position and in a compressed/retracted position, respectively, according to aspects of the invention.
Figure 3B:
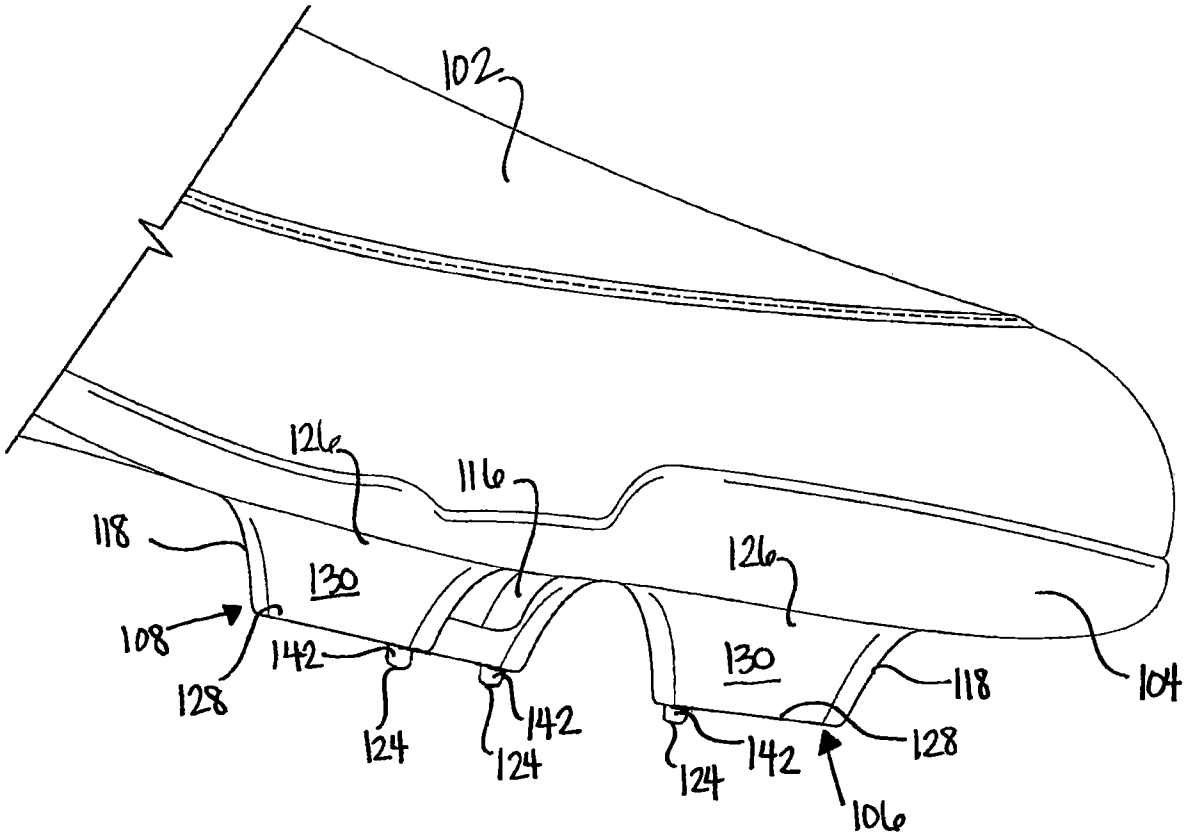

At least a portion of the stud body 118 and a tip 124 of the pin 120 form a ground-contact surface of the self-adjusting studs 106, 108, 110, and 112. The stud body 118 is in a first, extended position when the self-adjusting studs 106, 108, 110, and 112 contact a surface having a first hardness and the stud body 118 is in a second, retracted position when the self-adjusting studs 106, 108, 110, and 112 contact a surface having a second hardness that is greater than the first hardness. FIGS. 3A and 3B illustrate the stud body 118 in the first, extended position and the second, retracted position, respectively. In the first, extended position, the tip 124 of the pin 120 extends slightly beyond the height of the stud body 122, as illustrated in FIG. 3A. In the second, retracted position, the stud body 118 retracts (or otherwise compresses, becomes reduced in size and/or volume, etc.) so that it exposes a larger portion of the pin 120 (e.g., the tip 124 of the pin 120 plus additional length along a body 142 of the pin 120), as illustrated in FIG. 3B. This relatively thin, narrow, hard pin 120 can better pierce the hard ground when the stud body 118 retracts, thereby digging into the hard ground and providing improved traction in the hard ground.

Figure 4A:
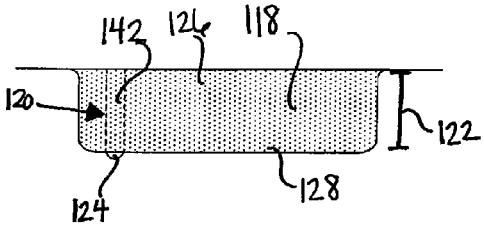
FIGS. 4A and 4B illustrate side views of a self-adjusting stud with a compressible foam material in an uncompressed/unretracted position and in a compressed/retracted position, respectively, according to aspects of the invention.
Figure 4B:
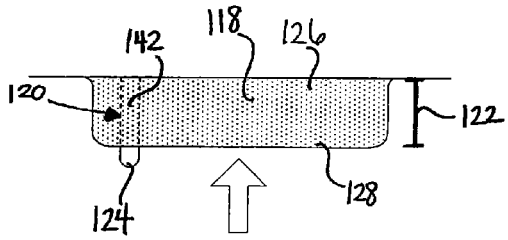

FIGS. 4A and 4B illustrate a side view of an embodiment of the self-adjusting studs. In this example, the stud body 118 includes a compressible foam or rubber-like material that compresses when a force is applied to the stud body 118 (the force is illustrated by the arrow in FIG. 4B). The self-adjusting stud body 118 compresses when it contacts a surface having a sufficient hardness. "Sufficient hardness," as used herein, is meant to include any surface that applies a force to the stud body 118 sufficient to cause it to compress/retract. When the force is removed, the stud body 118 extends back to its "uncompressed" or "unretracted" (i.e., natural) state. The compressible foam material of the stud body 118 biases the stud body 118 back to its uncompressed/unretracted position. A spring also may be included in the stud body 118 and also may help to bias the stud body 118 back to its uncompressed/unretracted position after a force has been removed from the self-adjusting stud. The spring may be any type of spring, such as a coil spring or leaf spring.

Figure 5A:
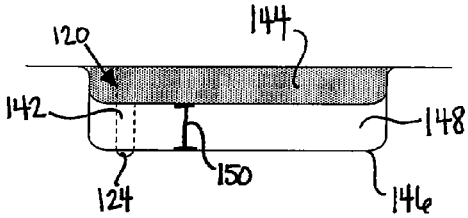
FIGS. 5A and 5B illustrate side views of a self-adjusting stud with a spring in an uncompressed/unretracted position and in a compressed/retracted position, respectively, according to aspects of the invention.
Figure 5B:
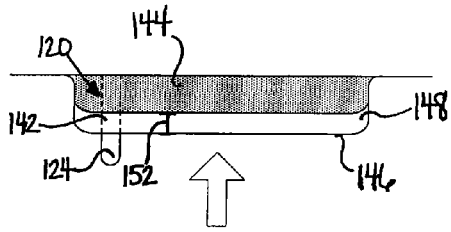

FIGS. 5A and 5B illustrate a side view of an embodiment of the self-adjusting stud. In this embodiment, the stud body 118 includes a two-plate structure that comprises a first plate 144 and a second plate 146 defining a space 148 therebetween. When the stud body 118 is in the first, extended (uncompressed) position, the space 148 between the first plate 144 and the second plate 146 is a first distance 150. When a force is applied to the self-adjusting stud sufficient enough to compress the stud body 118 (e.g., when the self-adjusting stud contacts hard ground), the stud body 118 retracts or compresses to its second, retracted (compressed) position. In the second, retracted (compressed) position, the space 148 between the first plate 144 and the second plate 146 is a second distance 152. The first distance 150 between the first plate 144 and the second plate 146 (when the stud body 118 is in its first, unretracted/uncompressed position) is greater than the second distance 152 between the first plate 144 and the second plate 146 (when the stud body 118 is in its second, retracted/compressed position). Within the space 148 between the first plate 144 and the second plate 146 may be positioned compressible foam, a spring (e.g., a coil spring or leaf spring), or any other mechanism that will bias the first plate 144 and the second plate 146 back apart (i.e., back to the unretracted/uncompressed position of the stud body 118 once an applied force has been removed).

Figure 6:
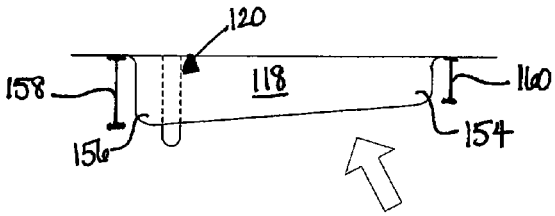
FIG. 6 illustrates a side view of a self-adjusting stud in which one portion/end is compressed more than another portion/end of the stud in accordance with aspects of the invention.

FIG. 6 illustrates a side view of a self-adjusting stud. In some examples, the stud body 118 has a first portion and a second portion that can compress/retract and uncompress/unretract different amounts. FIG. 6 illustrates an example construction in which the first portion is at a first end 154 of the stud body 118 and the second portion is at a second end 156 opposite the first end 154. In this example, when a force is applied to the self-adjusting stud, the first end 154 compresses/retracts a first distance 160 and the second end 156 compresses/retracts a second distance 158 that is greater than the first distance 160. This capability to compress different amounts along the stud body 118 length can help provide a more natural or comfortable feel as the applied forces move along the sole structure during a step cycle.

FIGS. 4A-7 illustrates various example constructions in which at least a portion of the stud body 118 is compressed. The stud body 118 may compress any desired amount. For example, the stud body 118 may compress up to 50% of the original uncompressed height of the stud body 118. In other examples, a portion of the stud body 118 may compress up to 50% of the original uncompressed height of the stud body 118. For example, FIGS. 5A and 5B illustrate the stud body 118 in an uncompressed state (FIG. 5A) and a compressed state (FIG. 5B), respectively. The compressed state of the stud body 118 illustrated in FIG. 5B is approximately 25% the height of the stud body 118 in the uncompressed state illustrated in FIG. 5A.

Figure 7:
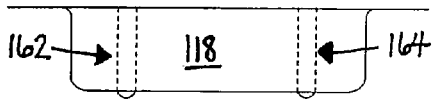
FIG. 7 illustrates a self-adjusting stud having two pins according to aspects of the invention.

FIG. 7 illustrates a side view of another example construction of a self-adjusting stud. In this example, the self-adjusting stud comprises a stud body 118 that has a first hole and a second hole. The self-adjusting stud also includes a first pin 162 extending through the first hole and a second pin 164 extending through the second hole. The self-adjusting stud may include any suitable or desired number of pins and corresponding holes.

This example embodiment of the self-adjusting stud is described and illustrated with elements that have a smooth, curved shape. Alternative embodiments may include elements that have one or more flat sides or any other configuration of contours and shapes.

D. SELF-ADJUSTING STUDS IN ARTICLES OF FOOTWEAR

Articles of footwear incorporating the self-adjusting studs may be athletic footwear known as "cleats" or "spikes." Such cleats having self-adjusting studs may be useful in a variety of sports such as soccer, baseball, golf, football, hiking, mountain climbing, lacrosse, field hockey, and the like.

Articles of footwear may include a sole structure and an upper attached to the sole structure that together define a void for receiving a foot of a wearer. The sole structure may include a sole base member and at least one of the self-adjusting studs described above. The self-adjusting studs are attached to or integrally formed with the sole base member. The sole structure may include two or more of the self-adjusting studs. In the examples in which the sole structure includes two or more self-adjusting studs, the self-adjusting studs may be all of the same construction or they may be different constructions. For example, a sole structure may include two self-adjusting studs in which one is of the construction described in the first embodiment described above and the second is of the construction described in the second embodiment described above.

The self-adjusting stud(s) may be positioned on the sole base member in any region of the sole structure. For example, one or more self-adjusting studs may be positioned in the forefoot region and/or heel region of the sole structure. More specifically, one or more self-adjusting studs may be positioned along either or both of the medial edge and the lateral edge of the forefoot and/or heel region of the sole structure.

D. CONCLUSION

While the invention has been described with respect to specific examples including presently implemented modes of carrying out the invention, numerous variations and permutations of the above described systems and methods may also be implemented. Thus, the spirit and scope of the invention should be construed broadly as set forth in the appended claims.

The invention claimed is:

1. A sole structure, comprising:

a sole base member; and a self-adjusting stud extending downward from the sole base member, the self-adjusting stud further comprising a stud body having first and second holes extending through a center region thereof, a first pin extending through the first hole, and a second pin extending through the second hole, wherein at least a portion of the stud body and tips of the first and second pins form a ground-contact surface of the self-adjusting stud, and the stud body is in a first, extended position when the self-adjusting stud contacts a surface having a first hardness and the stud body is in a second, retracted position when the self-adjusting stud contacts a surface having a second hardness that is greater than the first hardness.

2. The sole structure recited in claim 1, wherein the stud body includes a thermoplastic polyurethane material.

3. The sole structure stud recited in claim 1, wherein the stud body includes a compressible foam material.

4. The sole structure stud recited in claim 1, wherein the first pin includes a metal material.

5. The sole structure stud recited in claim 1, wherein the first pin has a length that extends through the first hole of the stud body, wherein the length of the first pin exceeds a width of the first pin.

6. The sole structure stud recited in claim 1, wherein a tip of the first pin is rounded.

7. The sole structure stud recited in claim 1, wherein the first pin has a length that extends through the first hole of the stud body, and wherein the length of the first pin exceeds a height of the stud body when the stud body is in the second, retracted position.

8. The sole structure stud recited in claim 1, wherein the first pin has a length that extends through the first hole of the stud body, and wherein the length of the first pin exceeds a height of the stud body when the stud body is in the first, extended position.

9. The sole structure of claim 1, comprising:

a second self-adjusting stud extending downward from the sole base member, the second self-adjusting stud further comprising a second stud first portion and a second stud second portion having a compressibility that is greater than a compressibility of the second stud first portion, wherein the second stud second portion surrounds the second stud first portion and has a perimeter generally defining a teardrop shape in a plane parallel to the sole base member.

10. The sole structure recited in claim 9, further comprising a third self-adjusting stud extending downward from the sole base member, the third self-adjusting stud further comprising a third stud first portion and a third stud second portion having a compressibility that is greater than a compressibility of the third stud first portion, wherein the third stud second portion surrounds the third stud first portion and has a perimeter generally defining a teardrop shape in a plane parallel to the sole base member.

11. The sole structure of claim 10, wherein the self-adjusting stud, the second self-adjusting stud and the third self-adjusting stud are positioned to frame a forefoot region along a border of the sole structure.

12. The sole structure of claim 10, wherein the second stud first portion is located near an edge of the second stud second portion and the third stud first portion is located near an edge of the third stud second portion.

13. The sole structure of claim 10, wherein each of the second stud second portion and the third stud second portion is formed from a thermoplastic polyurethane (TPU) having a hardness rating on the Shore A scale below 90, and wherein each of the second stud first portion and the third stud first portion is formed from one of a metal, a metal alloy, a TPU having a hardness rating on the Shore A scale above 90, or a TPU having a hardness rating on the Shore D scale above 40.

14. The sole structure recited in claim 10, wherein one of the self-adjusting stud, the second self-adjusting stud and the third self-adjusting stud is attached to the sole base member along a medial edge of a forefoot region of the sole structure and another of the self-adjusting stud, the second self-adjusting stud and the third self-adjusting stud is attached to the sole base member along a lateral edge of the forefoot region of the sole structure.

15. The sole structure of claim 9, wherein the second stud first portion is located near an edge of the second stud second portion.

16. The sole structure of claim 9, wherein the second stud second portion is formed from a thermoplastic polyurethane (TPU) having a hardness rating on the Shore A scale below 90, and wherein the second stud first portion is formed from one of a metal, a metal alloy, a TPU having a hardness rating on the Shore A scale above 90, or a TPU having a hardness rating on the Shore D scale above 40.

17. The sole structure recited in claim 9, wherein the second stud first portion includes thermoplastic polyurethane.

18. The sole structure recited in claim 9, wherein the second stud first portion includes a metal.

19. The sole structure recited in claim 9, wherein the second stud first portion is a pin.

20. The sole structure recited in claim 19, wherein a free end of the pin is flush with an exterior surface of the second stud second portion when the second stud second portion is substantially uncompressed.

21. The sole structure recited in claim 19, wherein the pin is recessed into the second stud second portion when the second stud second portion is substantially uncompressed.

22. The sole structure recited in claim 9, wherein the second stud second portion includes a compressible foam material.

23. The sole structure recited in claim 9, wherein a size of a compressed second stud second portion is at least 5% smaller than a size of an uncompressed second stud second portion.

24. The sole structure recited in claim 9, wherein a size of a compressed second stud second portion is at least 25% smaller than a size of an uncompressed second stud second portion.

* * * * *

UNITED STATES PATENT AND TRADEMARK OFFICE

CERTIFICATE OF CORRECTION

PATENT NO. : 8,533,979 B2
APPLICATION NO. : 12/708411
DATED : September 17, 2013
INVENTOR(S) : Brian Baker It is certified that error appears in the above-identified patent and that said Letters Patent is hereby corrected as shown below:

Claims

In Column 14, Claim 3, Line 33:
Please delete "stud"

In Column 14, Claim 4, Line 35:
Please delete "stud"

In Column 14, Claim 5, Line 37:
Please delete "stud"

In Column 14, Claim 6, Line 41:
Please delete "stud"

In Column 14, Claim 7, Line 43:
Please delete "stud"

In Column 14, Claim 8, Line 48:
Please delete "stud"

Signed and Sealed this
Twenty-seventh Day of October, 2015

Michelle K. Lee

Michelle K. Lee
*Director of the United States Patent and Trademark Office*